United States Patent [19]

Milewski et al.

[11] Patent Number: 4,864,186

[45] Date of Patent: Sep. 5, 1989

[54] SINGLE CRYSTAL WHISKER ELECTRIC LIGHT FILAMENT

[76] Inventors: John V. Milewski; Peter D. Milewski, both of P.O. Box 8029, Santa Fe, N. Mex. 87504

[21] Appl. No.: 175,052

[22] Filed: Mar. 29, 1988

[51] Int. Cl.[4] ..... H01K 1/10

[52] U.S. Cl. ..... 313/341; 313/578; 313/633

[58] Field of Search ..... 313/341, 343, 315, 633, 313/578

[56] References Cited

U.S. PATENT DOCUMENTS

| | | | |
|---|---|---|---|
| 821,017 | 5/1906 | Clark | 313/341 |
| 3,875,477 | 4/1975 | Fredriksson et al. | 317/98 |
| 4,513,030 | 4/1985 | Milewski | 427/227 |
| 4,565,600 | 1/1986 | Ricard | 156/608 |

OTHER PUBLICATIONS

Encylopedia of Materials Science and Engineering, "Whiskers", Milewski, Bever, ed., pp. 5344–5346, 1/86, Pergamon Press.

Journal of Materials Science, "Growth of Beta-Silicon Carbide Whiskers by the VLS process", Milewski et al., pp. 1160–1166, 1/85, Chapman and Hall.

*Primary Examiner*—Kenneth Wieder

[57] ABSTRACT

An electric light filament comprising a single crystal whisker is disclosed. In the preferred embodiment the whisker consists essentially of silicon carbide (SiC), preferably beta silicon carbide, doped with a sufficient amount of nitrogen to render the whisker sufficiently electrically conductive to be useful as a light bulb filament at household voltages. Filaments made of such materials are characterized by high strength, durability, and resilience, and have higher electrical emissivities than conventioanl tungsten filaments.

8 Claims, 1 Drawing Sheet

SINGLE CRYSTAL WHISKER ELECTRIC LIGHT FILAMENT

BACKGROUND OF THE INVENTION

1. Field of the Invention

The invention described and claimed herein is generally related to electric light filaments, and more particularly to materials used as such filaments.

2. Description of the related art.

Previously known electric light filaments are typically made of materials which are either polycrystalline in nature or which are amorphous, or noncrystalline, in nature. Such materials suffer from the disadvantage that they become brittle with time at elevated temperatures.

Polycrystalline materials, which include the majority of commercially available metallic filaments, are characterized by the presence of crystal grain boundaries, dislocations, voids and various other microstructural imperfections. These microstructural imperfections lead to grain growth and recrystallization, particularly at elevated temperatures, which in turn lead to increased brittleness and diminished strength.

Metallic filaments also suffer from a disadvantage that is a consequence of the relatively low electrical resistance that characterizes metallic filaments. The low electrical resistance requires that the filaments be made quite long, which in turn requires the filament to be tightly coiled in order to fit it into a light bulb of suitable size. Coiling of the filament effectively reduces the radiating surface area because the coiled filament partially occludes itself, thereby diminishing the radiative efficiency of the filament.

Another disadvantage of metallic filaments is that metals in general, and particularly tungsten, have a relatively high resistivity/temperature coefficient. From room temperatures to approximately 1200° C. the resistance of metal filaments increases as much a sixfold, resulting in high electrical power consumption at operating temperatures.

Amorphous metals used as filaments undergo various degrees of crystallization at elevated temperatures, resulting in the development of grain boundaries that decrease the strength and toughness of these materials also. Additionally amorphous materials are often of lower strengths initially relative to crystalline materials.

Accordingly, it an object and purpose of the present invention to provide an electric light filament which is of improved strength, durability and resilience, particularly at elevated temperatures.

It is also an object and purpose of the present invention to provide an electric light filament which does not undergo progressive crystallization or recrystallization at incandescent temperatures.

SUMMARY OF THE INVENTION

The present invention provides an electric light filament comprising a single crystal fiber known as a "whisker." The whisker is preferably a high emissivity ceramic whisker. In the preferred embodiment the whisker consists essentially of a monocrystalline fiber of silicon carbide, most preferably beta silicon carbide. Such filaments are characterized by high mechanical strength and durability at the elevated temperatures required to achieve incandescence. Also, such crystals are characterized by their high surface area to volume ratios, as a result of their typically small cross-sectional diameters, which are on the order of about 5 microns.

They are also characterized by their high electrical resistances and high emissivities relative to metals. Additionally, the resistance of silicon carbide does not increase with temperature as much as tungsten, such that power consumption of a silicon carbide whisker is lower at incandescent operating temperatures. In accordance with another aspect of the invention, the silicon carbide whisker is doped with nitrogen to increase the conductivity of the whisker to a level appropriate for use of the whisker as an electric light filament.

These and other aspects of the present invention will be more apparent upon consideration of the following detailed description of the preferred embodiments of the invention.

The invention will be more readily understood by referring to the figure of the drawing.

FIG. 1 is a plan view of the electric light filament.

In greater detail FIG. 1 shows Single Crystal Filament (1).

DESCRIPTION OF THE PREFERRED EMBODIMENTS

Figure 1:
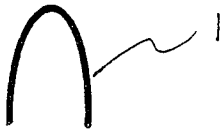

Whiskers are minute, high purity, single crystal fibers. More than a hundred materials, including metals, oxides, carbides, halides, nitrides, an carbonaceous materials have been prepared as whiskers. As a consequence of their high chemical purity and monocrystalline structures, whiskers are characterized by very high mechanical tensile strengths, which in the case of some materials approach the theoretical maximum strength of the material based on actual interatomic bonding forces. Because of their high tensile strengths, whiskers have been primarily of interest as agents used to reinforce ceramic, metallic and even polymeric matrices.

In addition to the high mechanical strength that results from the highly ordered crystalline structure of whiskers, other significant and, to some extent, unexpected changes are obtained in the optical, magnetic, dielectric and electrical conductivity of materials that are formed as whiskers.

Ceramic whiskers are unique in that they can be strained elastically as much as three percent without permanent deformation, compared with about 0.1 percent for bulk ceramic materials. In addition, whiskers exhibit considerably less strength deterioration with increasing temperatures than the best conventional high-strength metal alloys. Further, no appreciable fatigue effects have been observed in whiskers. They can be handled roughly, milled or chopped, elevated to high temperatures, and otherwise worked without any appreciable loss of strength.

Whiskers can be produced in a range of fiber sizes and fiber forms. A number of processes are known for producing whiskers in various forms, including forms known by terms such as grown wool, felted paper and loose fibers.

Some ceramic materials are semiconductors, and are known to be very resistant to current flow. However, it is known that by doping silicon carbide with nitrogen, which becomes located interstitially within the silicon carbide crystal structure, the electrical conductivity of the silicon carbide can be increased to a level that permits its use as an incandescent electric light filament. In this regard, the emissivity of silicon carbide is also particularly conducive to this use, lying in the range of 0.9, which is considerably higher than the emissivity of approximately 0.4 that characterizes most metallic filaments.

These characteristics are all conducive to the new use of whiskers, provided by the present invention, as electric light filaments.

A demonstration of the present invention was conducted using a number of single crystal whiskers of beta silicon carbide (SiC). The whiskers were doped green with nitrogen. The whiskers ranged from three (3) millimeters to thirty (30) millimeters in length and were approximately five (5) microns in diameter. The whiskers were mounted between two wire binding posts which were spaced approximately three millimeters apart. A direct voltage was applied to the whiskers across the binding posts, and the temperatures achieved in the whiskers were measured with an optical pyrometer. When 30 volts (d.c.) was applied to the whiskers, the whiskers glowed in the high red heat (800°–1,000° C.) region. Higher voltages in air caused the whiskers to burn out due to oxidation. In partial vacuum temperatures were of 1100° C. to 1440° C. were achieved in the whiskers before burnout.

The silicon carbide filaments were compared with conventional tungsten filaments. For both types of filaments, the properties of electrical resistance, filament length, filament diameter and filament weight were measured. From the measured voltages and current readings, power requirements at various filament temperatures were calculated and are set forth below. Qualitative analyses of light output in lumens were done by comparing a silicon carbide filament to that of a candle, and a candle to a 4 watt clear glass tungsten filament light bulb. This was done using the dual screen method.

The temperatures, voltages and currents were measured simultaneously on each filament as the voltage was increased. Temperatures were measured using an optical pyrometer. Voltage and current readings were performed on a digital multimeter. The voltages were regulated using a variable transformer. The masses, lengths, and cross-sectional areas were also measured and/or calculated. For comparison, similar measurements were made on clear glass conventional 25-watt and 4-watt tungsten filament light bulbs. Data obtained from these tests, which compare the silicon carbide filament to the tungsten filament, are given in Tables I through V below.

TABLE I

| Comparative Physical Property Data | | | |
|---|---|---|---|
| | Beta SiC Whisker | Coiled Tungsten | Ratio SiC/W |
| Mass (mg) | .002 | 4.5 | 1/2500 |
| Length (mm) | 30 | 32 | 1/1 |
| | | 300 (uncoiled) | 10/1 |
| Diameter (microns) | 5 | 250 | 1/50 |
| Resistance (Ohms) | 1800–3100 | 74 (25 watts) | 25/1 |
| | | 560 (4 watts) | 5/1 |
| Effective Radiating Surface Area to Volume Ratio | 2.86 | .077 | 36/1 |
| Emissivity at 1200° C. | .90 | .40 | 2.3/1 |
| Resistance Change, Room Temp. to 1200° C. | 2x | 6x | 1/3 |

TABLE II

| Tungsten 4 Watt Bulb | | | | |
|---|---|---|---|---|
| Voltage (volts) | Current (ma) | Power (watt) | Resistance (ohms) | Temperature (°C.) |
| .77 | 1.36 | .001 | 560 | — |

TABLE II-continued

| Tungsten 4 Watt Bulb | | | | |
|---|---|---|---|---|
| Voltage (volts) | Current (ma) | Power (watt) | Resistance (ohms) | Temperature (°C.) |
| 6.0 | 4.65 | .028 | 1300 | — |
| 10.2 | 7.36 | .075 | 1390 | — |
| 15.0 | 9.48 | .142 | 1580 | first light |
| 19.6 | 11.11 | .218 | 1760 | 800 |
| 23.0 | 12.79 | .294 | 1800 | 860 |
| 28.3 | 14.32 | .405 | 1980 | 920 |
| 32.7 | 15.76 | .515 | 2070 | 980 |
| 37.0 | 17.12 | .633 | 2160 | 1030 |
| 41.6 | 18.52 | .770 | 2250 | 1080 |
| 46.1 | 19.72 | .909 | 2340 | 1120 |
| 50.8 | 20.92 | 1.06 | 2430 | 1180 |
| 55.4 | 22.17 | 1.23 | 2500 | 1235 |
| 59.8 | 23.07 | 1.38 | 2590 | 1290 |
| 64.1 | 24.33 | 1.56 | 2630 | 1340 |
| 68.4 | 25.35 | 1.73 | 2700 | 1390 |
| 72.7 | 26.44 | 1.92 | 2750 | 1390 |
| 77.3 | 27.48 | 2.12 | 2810 | 1420 |
| 81.8 | 28.41 | 2.32 | 2880 | 1420 |
| 86.0 | 29.32 | 2.52 | 2930 | 1430 |
| 90.2 | 30.00 | 2.71 | 3000 | 1480 |
| 94.6 | 31.05 | 2.94 | 3050 | 1480 |
| 98.9 | 31.99 | 3.16 | 3090 | 1510 |
| 103.0 | 32.76 | 3.374 | 3140 | 1530 |
| 107.0 | 33.67 | 3.603 | 3180 | 1530 |
| 111.4 | 34.30 | 3.821 | 3190 | 1550 |
| 115.7 | 35.94 | 4.158 | 3220 | 1560 |
| 119.7 | 35.89 | 4.296 | 3340 | 1575 |
| 123.6 | 36.72 | 4.539 | 3370 | 1585 |

TABLE III

| Tungsten 25 Watt Bulb | | | | |
|---|---|---|---|---|
| Voltage (volts) | Current (ma) | Power (watt) | Resistance (ohms) | Temperature (°C.) |
| .77 | 10.4 | .008 | 74 | — |
| 10.2 | 74.9 | .76 | 136 | — |
| 19.6 | 90.8 | 1.8 | 216 | — |
| 28.3 | 102.2 | 2.9 | 277 | — |
| 37.0 | 110.5 | 4.1 | 335 | 930 |
| 46.1 | 118.6 | 5.5 | 389 | 1070 |
| 55.4 | 126.9 | 7.0 | 437 | 1212 |
| 64.1 | 134.3 | 8.6 | 478 | 1330 |
| 72.7 | 141.0 | 10.3 | 516 | 1410 |
| 81.8 | 148.0 | 12.1 | 553 | 1450 |
| 90.2 | 156.6 | 14.1 | 576 | 1550 |
| 98.9 | 162.8 | 16.1 | 607 | 1630 |
| 107.0 | 169.4 | 18.1 | 632 | 1720 |
| 115.7 | 175.9 | 20.4 | 658 | 1830 |
| 123.6 | 181.1 | 22.4 | 682 | 1900 |

TABLE IV

| Silicon Carbide Whisker Filament | | | | |
|---|---|---|---|---|
| Voltage (volts) | Current (ma) | Power (watt) | Resistance (ohms) | Temperature (°C.) |
| .775 | .43 | — | 1802 | — |
| 10.6 | 5.89 | — | 1800 | — |
| 19.6 | 10.00 | — | 1960 | — |
| 28.29 | 13.3 | — | 2127 | — |
| 36.99 | 15.43 | — | 2400 | — |
| 46.09 | 17.07 | .78 | 2700 | 800 |
| 50.77 | 17.50 | .89 | 2900 | 850 |
| 55.44 | 18.00 | 1.00 | 3080 | 950 |
| 59.79 | 18.45 | 1.10 | 3240 | 1060 |
| 64.13 | 18.80 | 1.21 | 3410 | 1170 |
| 68.42 | 19.10 | 1.31 | 3582 | 1260 |

TABLE V

| Silicon Carbide Whisker Filament | | | | |
|---|---|---|---|---|
| Voltage (volts) | Current (ma) | Power (watt) | Resistance (ohms) | Temperature (°C.) |
| .77 | .25 | .0002 | 3080 | — |

TABLE V-continued

| Voltage (volts) | Silicon Carbide Whisker Filament Current (ma) | Power (watt) | Resistance (ohms) | Temperature (°C.) |
|---|---|---|---|---|
| 6.0 | 1.71 | .010 | 3500 | — |
| 10.2 | 2.50 | .025 | 4080 | — |
| 15.0 | 3.28 | .049 | 4570 | 760 |
| 19.6 | 3.96 | .078 | 4950 | 850 |
| 23.0 | 4.49 | .103 | 5120 | 900 |
| 28.3 | 4.92 | .139 | 5750 | 1050 |
| 32.7 | 5.16 | .169 | 6330 | 1140 |
| 37.0 | 5.45 | .191 | 6790 | 1250 |
| 41.6 | 5.40 | .227 | 7700 | 1340 |
| 46.1 | 5.60 | .258 | 8230 | 1400 |

As summarized in Table I, the resistance of the tungsten filaments increases six-fold over the temperature range from room temperature to 1200° C., wherease the silicon carbide filaments increase in resistance only two-fold. Also, the emissivity of the silicon carbide whisker filaments at 1200° C. is on the order of 0.9, whereas the emissivity of the tungsten filament is on the order of 0.4.

One surprising discovery is that silicon carbide whiskers are considerably more efficient as electric light filaments than conventional tungsten filaments. Comparisons with conventional tungsten filaments have indicated that, to achieve a particular incandescent temperature, silicon carbide filaments require significantly less electrical power than a comparble tungsten filament. This is thought to be a consequence of a higher surface area to volume ratio in the silicon carbide whiskers than in tungsten filaments, and possible also due to a higher emissivity in silicon carbide whiskers than in tungsten filaments.

These advantages are considered to be a consequence of a higher resistance and a higher surface area to volume ratio in the silicon carbide whiskers than in tungsten filaments, as well as a higher emissivity in silicon carbide than in tungsten filaments.

From a review of the foregoing data, it is evident that because of the physical structure of the silicon carbide whisker and its significantly different physical, mechanical and electrical properties, single crystal whisker filaments have many superior performance properties and as a result produce a more efficient light bulb filament when compared to conventional polycrystalline metallic tungsten wire filaments.

Although the present invention is described herein by reference to a preferred embodiment of the invention, it will be understood that various modifications, alterations and substitutions which may be apparent to one of ordinary skill in the art may be made without departing from the essential invention. Accordingly, the present invention is defined by the following claims.

We claim:

1. An electric light filament comprising a single crystal whisker of a high emissivity material sufficiently conductive to achieve luminescence by application of an electric current to said whisker.

2. The electric light filament defined in claim 1 wherein said material is a ceramic.

3. The electric light filament defined in claim 2 wherein said filament consists essentially of silicon carbide (SiC).

4. The electric light filament defined in claim 3 wherein said silicon carbide is beta silicon carbide.

5. The electric light filament defined in claim 4 wherein said beta silicon carbide is doped with nitrogen.

6. The electric light filament defined in claim 5, wherein said beta silicon carbide is high electrical emissivity silicon carbide.

7. The filament defined in claim 6 wherein the length and diameter of said filament are such that the total resistance of the filament is on the order of from 1 to 10,000 ohms.

8. The filament defined in claim 7 wherein the length and diameter of said filament are such that the total resistance of said filament is on the order of from 500 to 5,000 ohms.

* * * * *